US005768842A

United States Patent [19]

Austin

[11] Patent Number: 5,768,842

[45] Date of Patent: Jun. 23, 1998

[54] WEEP DRAIN FOR TILE WALLS

[76] Inventor: Robert M. Austin, 15425 Sierra Morena Ct., Morgan Hill, Calif. 95037

[21] Appl. No.: 671,658

[22] Filed: Jun. 28, 1996

[51] Int. Cl.[6] ..... E04B 1/70

[52] U.S. Cl. ..... 52/302.3; 52/35; 52/169.5; 52/302.1; 52/442; 4/546; 4/597

[58] Field of Search ..... 4/546, 597, 661, 4/671, 679; 52/27, 34, 35, 169.5, 302.1, 302.3, 302.4, 302.6, 344, 390, 391, 392, 415, 442

[56] References Cited

U.S. PATENT DOCUMENTS

| | | | |
|---|---|---|---|
| 1,919,354 | 7/1933 | Anderson | 52/35 |
| 2,197,874 | 4/1940 | Myers | 52/35 X |
| 2,645,824 | 7/1953 | Titsworth | 52/302.3 |
| 2,657,570 | 11/1953 | Moore | 52/302.6 X |
| 2,934,931 | 5/1960 | Johnson | 52/302.6 X |
| 4,253,285 | 3/1981 | Enright | 52/302.3 |
| 4,612,742 | 9/1986 | Bevilacqua | 52/302.3 |
| 5,371,980 | 12/1994 | Dix | 52/34 |

*Primary Examiner*—Carl D. Friedman
*Assistant Examiner*—Kevin D. Wilkens
*Attorney, Agent, or Firm*—Thomas E. Schatzel; Law Offices of Thomas E. Schatzel

[57] ABSTRACT

A weep drain for a tile wall includes a dam for collecting water, moisture, or other liquids and an extrusion with a plurality of hollow cylindrical tubes for allowing the water, moisture or other liquids to drain from behind the tile wall.

9 Claims, 4 Drawing Sheets

WEEP DRAIN FOR TILE WALLS

BACKGROUND OF THE INVENTION

1. Field of the Invention

The present invention relates generally to showers and bathtubs and more particularly to a drainage system for tile walls.

2. Description of the Prior Art

A shower, bathtub, shower/bathtub combination or other area where water is often found usually includes one or more tile walls. Referring to FIG. 1, the exterior portion of tile wall 100 includes tiles 102 and caulking or grout 104. Referring to FIG. 2, the interior portion of a tile wall may include mortar 202, a moisture barrier 204 such as paper, a hard surface 206 such as plywood, and structural framing 208 such as wooden two by fours.

As the tile wall 100 ages or faces external forces, holes 106 or cracks 108 may develop in the grout 104 or tiles 102. As water splashes against tile wall 100, holes 106 or cracks 108 may allow moisture to seep behind into the mortar 202 and collect at a base 210 of the tile wall 100. Additionally water that splashes against the tile wall 100 is usually at a different temperature then the tile wall itself such that condensation may occur within the tile wall causing additional moisture to collect at its base 210. It is desirable to remove the moisture that collects within the structure of a tile wall in order to prevent potential damage to any part of the tile wall.

In the prior art, a number of patents have been issued that attempt to solve the problem of water escaping from a bathtub, shower or shower/bathtub combination and out onto a bath room floor. Other patents have been issued that redirect the water that normally would rest around the rim of a bathtub back into the tub.

U.S. Pat. No. 4,944,050 which issued Jul. 31, 1990 to Shames et al. discloses a splash guard for a bathtub/shower combination that keeps splashing water from escaping from the enclosure and out onto the bathroom floor.

U.S. Pat. No. 4,765,001 which issued Aug. 23, 1988 to William J. Smith disclose a splash guard for a shower that holds the shower curtain in place and keeps splashing water from escaping the shower enclosure.

U.S. Pat. No. 3,984,880 which issued Oct. 12, 1976 to Arnold F. Schrameyer discloses a concave and convex splash guard and diverter that is placed at the corners of the tub of a shower/bathtub combination that keeps water from splashing out of the bathtub onto the bathroom floor and redirects the splashed water back into the bathtub.

U.S. Pat. No. 4,620,332 which issued Nov. 4, 1986 to Owen A. Laird discloses a splash collector that is attached to the outside of a bathtub to collect the water that overflows or splashes out of the bathtub before it can collect on the floor of a bathroom.

U.S. Pat. No. 4,473,911 which issued Oct. 2, 1984 to Sylvia A. Germain discloses a water diverting system that is affixed to the bathtub rim of a bathtub/shower combination which redirects the water that normally would collect on the rim of the bathtub and directs it back into the tub for disposal down the drainpipe.

It is thought that these patents listed above do disclose a solution to removing moisture that has collected and become trapped behind a tile wall. It is desirable to provide a means for water trapped behind a tile wall to escape into a bathtub, a shower pan, or exterior portion of the tile wall for drainage and prevention of damage to the interior portions of the wall or structure.

SUMMARY OF THE INVENTION

It is an object of the present invention to provide a means from which moisture may escape from behind a tile wall.

Another object of the present invention is to reduce the potential damage that trapped moisture may cause to interior portions of a tile wall or its structure.

Briefly, the present invention includes a weep drain for a tile wall which includes a dam for collecting moisture or liquid and an extrusion with a plurality of hollow cylindrical tubes for allowing the moisture or liquid to drain from behind the tile wall.

An advantage of the present invention is that moisture that collects behind a tile wall is provided with a means of escape.

Another advantage of the present invention is that the potential damage that may be caused by moisture trapped behind a tile wall is reduced.

These and other objects and advantages of the present invention will no doubt become obvious to those of ordinary skill in the art after having read the following detailed description of the preferred embodiment which is illustrated in the various drawing figures.

IN THE DRAWINGS

DETAILED DESCRIPTION OF THE PREFERRED EMBODIMENT

The present invention provides a means of escape to an exterior area for water, moisture or other liquids that normally collect and become trapped behind a tile wall.

Figure 1:
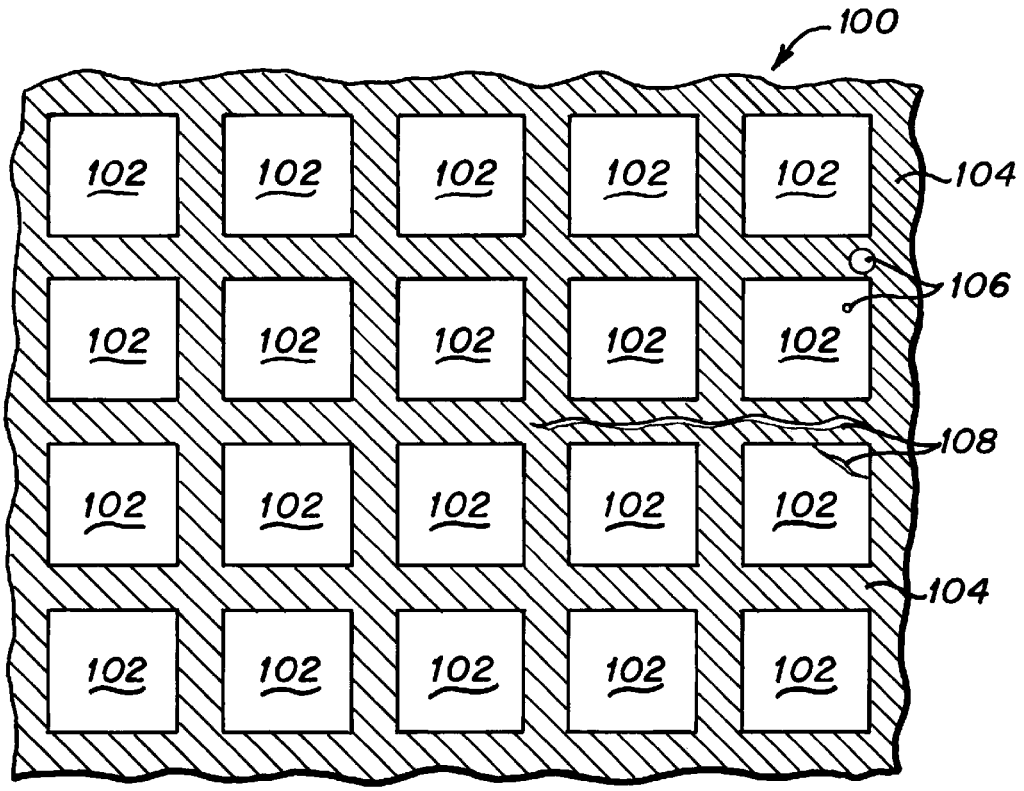
Fig 1 (PRIOR ART)
FIG. 1 is a perspective view of a tile wall.
Figure 2:
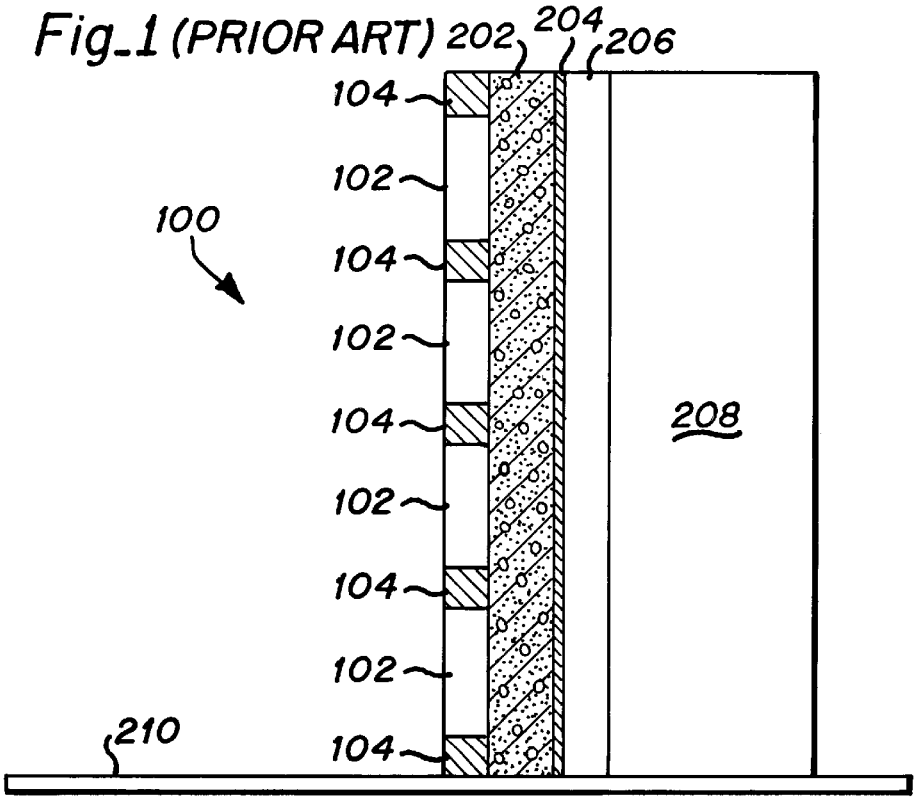
Fig 2 (PRIOR ART)
FIG. 2 is a cross sectional view of the tile wall of FIG. 1.
Figure 3A:
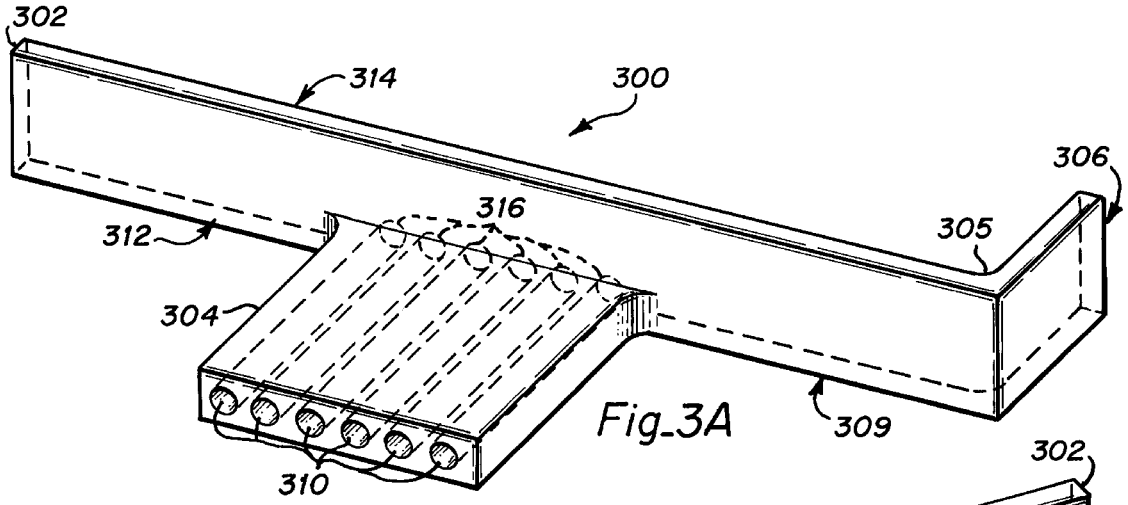
FIG. 3A is a magnified front view of a right side weep drain of the present invention.
Figure 3B:
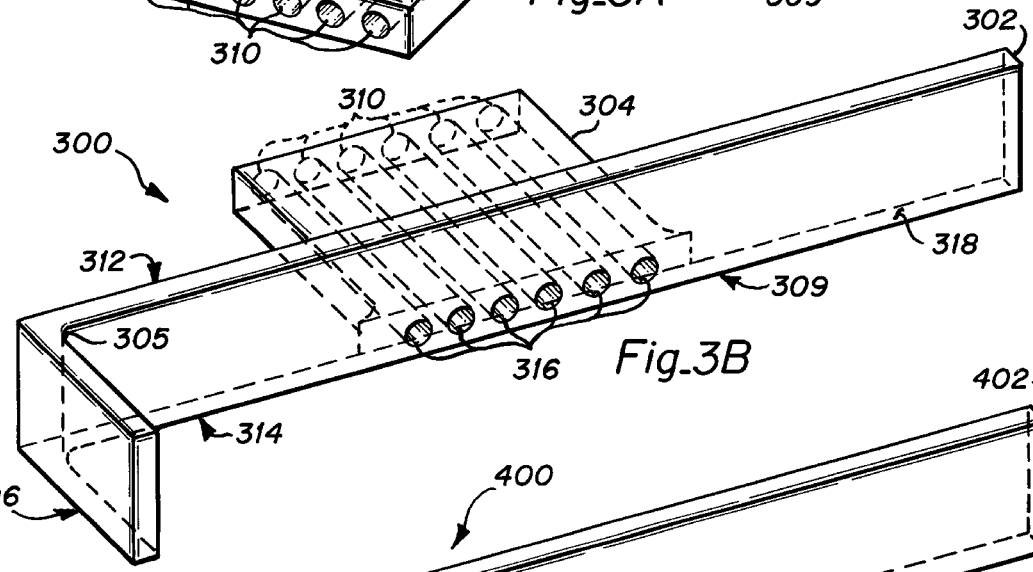
FIG. 3B is a magnified back view of the weep drain of FIG. 3A.

FIG. 3A illustrates a first preferred embodiment of the present invention referred to as a right side weep drain having a general reference character designation of 300. Weep drain 300 includes a dam 302 and an extrusion 304. The dam 302 is a wall that is shaped somewhat like a hockey stick having an angular bend 305 preferably of ninety degrees generating a right angled side 306. The extrusion 304 is coupled near a base 309 of the dam 302 and includes a plurality of hollow cylindrical tubes 310 that extend from a front side 312 of the weep drain 300, through the dam 302, to a back side 314 of the weep drain 300. Referring to FIG. 3B, holes 316 at an interior face 318 of the dam 302 illustrate the openings at the base of the dam 302 into the cylindrical tubes 310. Water, moisture, or other liquids that would normally accumulate behind a tile wall, flow into the holes 316 through the tubes 310 of the extrusion 304 and then out at an exterior to the tile wall. The weep drain 300 is preferably made of a solid such as plastic, rubber or polypropoline material and may have a color that matches the color of the tile, grout or caulking material which is preferably white. Typical dimensions of the dam 302 are approximately three-fourths inches high, one-eight inch thick, six inches in length with an angled side of five-eights inches in length. Ninety degrees is the preferred angle for the angular bend 305 that the right angle side 306 has with front side 312 of the dam 302. The thickness of the dam at the angular bend 305 is approximately one-fourth of an inch. The extrusion 304 is preferably coupled near the center portion of the front side 312 of the dam 302. The typical exterior dimensions of the extrusion 304 are approximately two inches wide, seven-thirty seconds of an inch high and one inch deep from the face of the front side 312. The hollow cylindrical tubes 310 within the extrusion 304 that pass through the dam 302 are approximately one-eighth inch in diameter and one and one-eighth inch in length.

Figure 4:
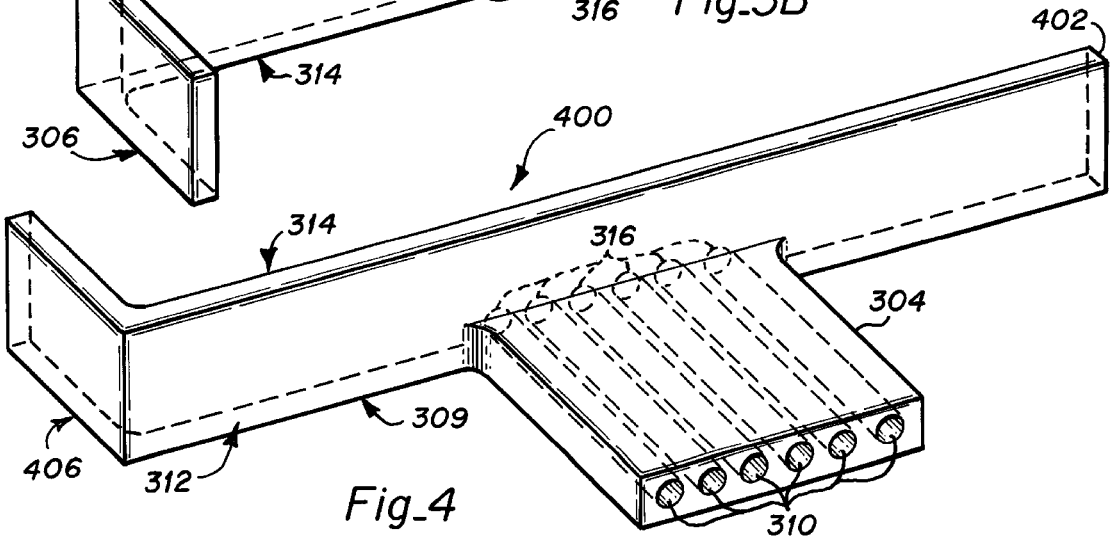
FIG. 4 is a magnified front view of a left side weep drain of the present invention.

FIG. 4 illustrates a second preferred embodiment of the present invention referred to as a left side weep drain having a reference character designation of 400. Weep drain 400 is very similar to weep drain 300. Weep drain 400 includes a dam 402 and an extrusion 304. The dam 402 is very similar to the description of the dam 302 except that instead of having a right angled side 306, dam 402 has a left angled side 406. Extrusion 304 includes hollow cylindrical tubes 310 and is similarly coupled to dam 402 when compared to dam 302. The typical dimensions of the weep drain 400 is similar to the weep drain 300.

Figure 5:
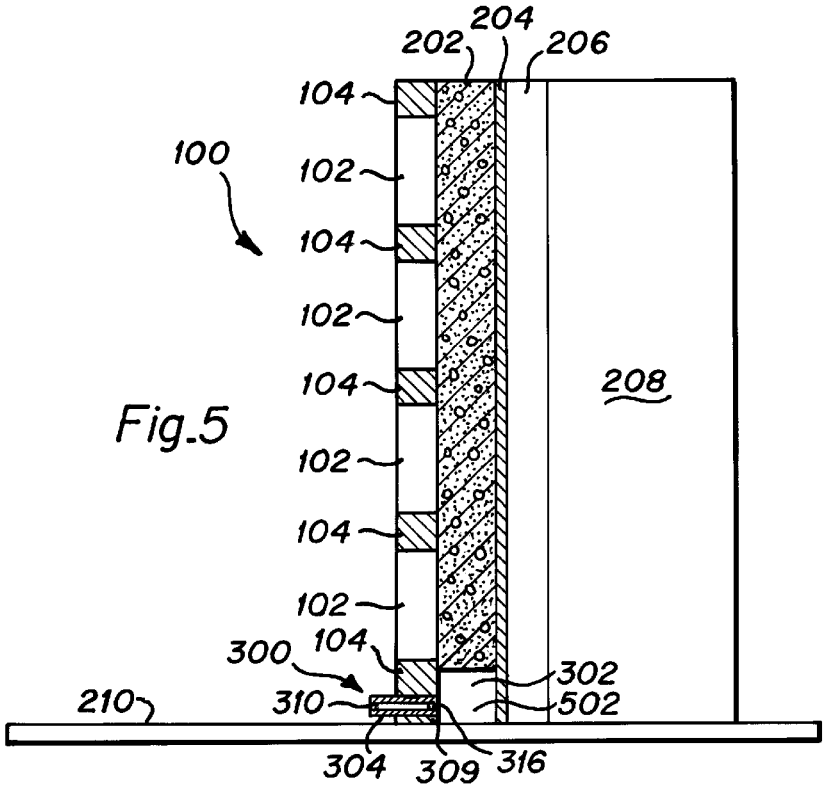
FIG. 5 is a cross sectional view of a tile wall incorporating the weep drain of FIG. 3A.

FIG. 5 illustrates right weep drain 300 inserted into the tile wall 100. At its base 309 the weep drain 300 couples to base 210. Extrusion 304 couples to the caulking or grout 104 and possibly a portion of the mortar 202 while the dam 302 couples to the mortar 202 generating a cavity or trough 502. As water, moisture, or other liquids fall into the trough 502, the hollow cylindrical tubes 310 allow the water, moisture or other liquid to escape to the exterior of the tile wall 100. Left weep drain 400 may similarly be installed within the tile wall 100.

Figure 6:
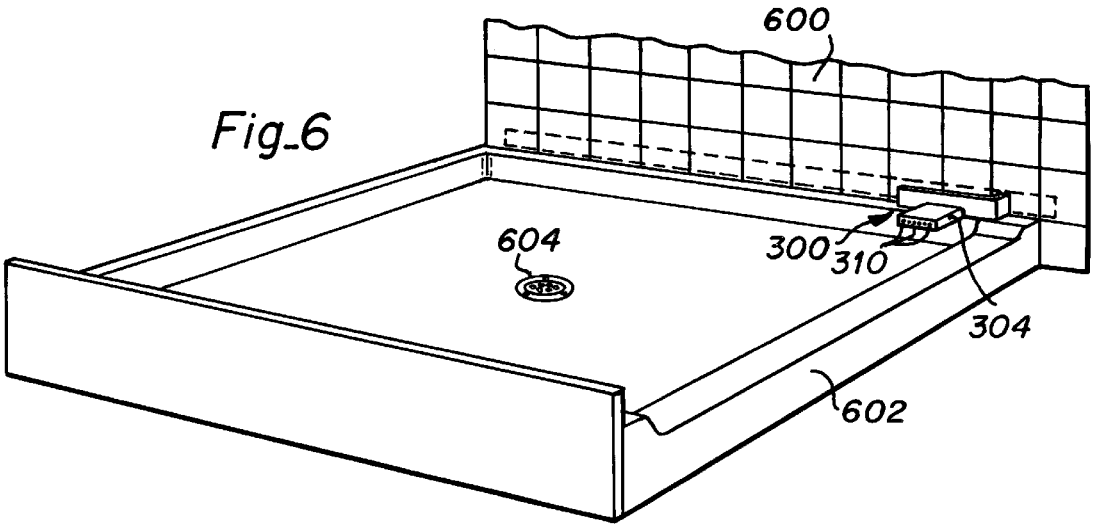
FIG. 6 is an perspective view of a shower tile wall incorporating the weep drain of FIG. 3A.

FIG. 6 illustrates the right weep drain 300 inserted into a tile shower wall 600. The extrusion 304 is aligned such that water, moisture or other liquids will fall into a shower pan 602. Right weep drain 300 is usually inserted into the right side of a tile wall while the left weep drain 400 is usually inserted into the left side of a tile wall. In either case it is usually inserted nearest a shower door (not illustrated). The hollow cylindrical tubes 310 within the extrusion 304 allow the water, moisture, or other liquids to escape from behind the tile shower wall 600 into the shower pan 602 for drainage down a drain 604.

Figure 7:
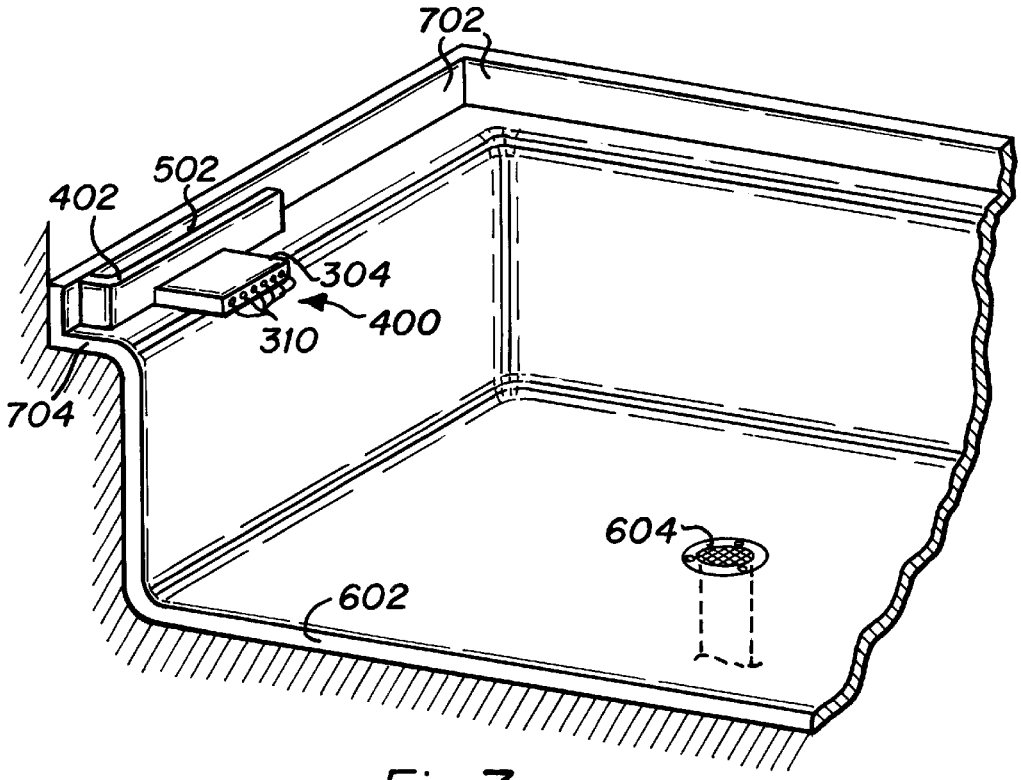
FIG. 7 is an perspective view of a shower tile wall incorporating the weep drain of FIG. 4.

FIG. 7 illustrates the left weep drain 400 being assembled together with the shower pan 602. The shower pan 602 includes a shower pan lip 702 and the drain 604. The dam 402 of the weep drain 400 and the lip 702 of the shower pan 602 form the trough 502 which collects the water and diverts it to the hollow cylindrical tubes 310 within the extrusion 304. The left weep drain 400 is preferably installed near the shower door at a shower pan corner 704.

Figure 8:
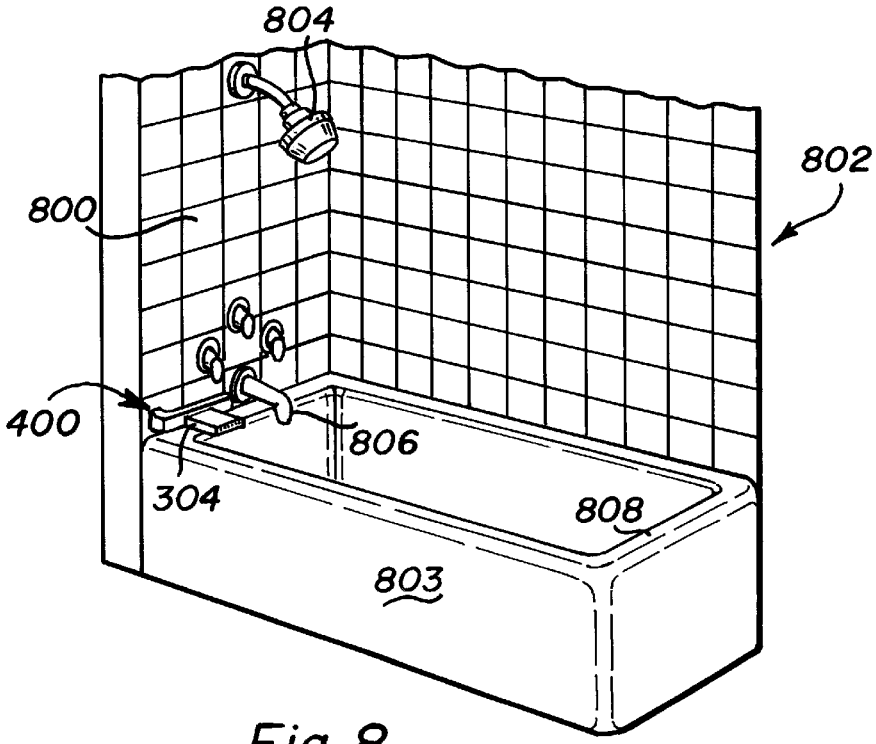
FIG. 8 is an cutaway view of a tile wall incorporating the weep drain of FIG. 4.

FIG. 8 illustrates the left weep drain 400 installed into a bathtub tile wall 800 of a bathtub/shower combination 802. The bathtub/shower combination 802 includes a bathtub 803, the bathtub tile wall 800, a shower head 804 and a bathtub water spigot 806. The bathtub 803 includes a rim 808 and the drain 604 (not illustrated in FIG. 8). In order to assure that the water, moisture or other liquid flowing through the weep drain 400 is emptied into the bathtub and not on the bathtub rim 808, the extrusion 304 may have a longer length.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A weep drain (300, 400) for integral engagement to a tile wall (100, 600, 800) for allowing water, moisture, or other liquids to drain from behind the tile wall (100, 600, 800) to the exterior of the tile wall, the weep drain (300, 400) comprising:

a dam (302, 402) for integral coupling to said tile wall, the dam having a first exterior planar surface for positioning in a plane parallel with a plane of said tile wall, a base (309) for integral engagement to said tile wall with a first interior surface opposite said first exterior surface, the dam having a curved portion (306, 406) at one end and a plurality of holes (316) penetrating said base (309) from said first exterior surface to said first interior surface for collecting and diverting water, moisture, or other liquids from about said first interior surface to said plurality of holes (316); and an extrusion (304) coupled to the dam (302, 402) at said first exterior planar surface with a plurality of centrally located hollow cylindrical tubes (310) respectively coupled to said plurality of holes (316) in the dam (302, 304) and projecting from said first exterior planar surface for allowing said water, moisture, or other liquids to drain from said first interior side through said cylindrical tubes.

2. The weep drain of claim 1 wherein said curved portion (306) of the dam (302) is located at a right end.

3. The weep drain of claim 1 wherein said curved portion (406) of the dam (402) is located at a left end.

4. The weep drain of claim 1 wherein said base (309) of the dam (402) includes a bottom exterior surface for coupling to a lip (702) of a shower pan (602) and generating a trough (502) for collecting and draining water, moisture, or other liquids into a drain (604) of said shower pan (602).

5. The weep drain of claim 1 wherein said base (309) of the dam (302, 402) includes a bottom exterior surface for coupling to a rim (808) of a bathtub (803) and generating a trough (502) for collecting and draining water, moisture, or other liquids into a drain (604) of said bathtub (803).

6. A shower tile wall (600) for protecting a structural frame of a house and providing means for escape of water, moisture, or other liquids trapped behind said wall, the shower tile wall (600) comprising:

a structural frame (206) to provide support;

mortar (202) coupled to the structural frame (206);

a plurality of tiles (102) coupled to the mortar (202);

grout (104) coupled to the plurality of tiles (102) for sealing and allowing expansion and contraction of the shower tile wall (600); and a first weep drain located at a first end of the shower tile wall (600), said first weep drain comprising, a dam (302, 402) integrally coupled to the shower tile wall (600), the dam having a first exterior planar surface positioned in a plane parallel with a plane of said shower tile wall, a base (309) integrally engaged to said shower tile wall with a first interior surface opposite said first exterior surface, the dam having a curved portion (306, 406) at one end and a plurality of holes (316) penetrating said base (309) from said first exterior surface to said first interior surface and opening to an interior side of said tile wall for collecting and diverting water, moisture, or other liquids from said interior side of said shower tile wall to said plurality of holes (316); and an extrusion (304) coupled to the dam (302, 402) at said base with a plurality of centrally located hollow cylindrical tubes (310) respectively coupled to said plurality of holes (316) in the dam (302, 304) and projecting to an exterior side of said shower tile wall for allowing said water, moisture, or other liquid to drain from said interior side to said exterior side of said shower tile wall (600).

7. The shower tile wall of claim 6 further comprising:

a second weep drain located at a second end of the shower tile wall (600) opposite said first end, said second weep drain comprising, a dam (302, 402) integrally coupled to the shower tile wall (600), the dam having a first exterior planar surface positioned in a plane parallel with said plane of said shower tile wall, a base (309) integrally engaged to said shower tile wall with a first interior surface opposite said first exterior surface, the dam having a curved portion (306, 406) at one end and a plurality of holes (316) penetrating said base (309) from said first exterior surface to said first interior surface and opening to an interior side of said shower tile wall for collecting and diverting water, moisture, or other liquids from said interior side of said shower tile wall to said plurality of holes (316); and an extrusion (304) coupled to the dam (302, 402) at said base with a plurality of centrally located hollow cylindrical tubes (310) respectively coupled to said plurality of holes (316) in the dam (302, 304) and projecting to an exterior side of said shower tile wall for allowing water, moisture, or other liquids to drain from said interior side to said exterior side of said shower tile wall (600).

8. A bathtub tile wall (800) for protecting a structural frame of a house and providing means of escape for water, moisture, or other liquids trapped behind said wall, the bathtub tile wall (800) comprising:

a structural frame (206) to provide support;

mortar (202) coupled to the structural frame (206);

a plurality of tiles (102) coupled to the mortar (202);

grout (104) coupled to the tiles (102) for sealing and allowing expansion and contraction of the bathtub tile wall (800); and a first weep drain located at a first end of the bathtub tile wall (800), said first weep drain comprising, a dam (302, 402) integrally coupled to the bathtub tile wall (800), the dam having a first exterior planar surface positioned in a plane parallel with a plane of said bathtub tile wall, a base (309) integrally engaged to said bathtub tile wall with a first interior surface opposite said first exterior surface, the dam having a curved portion (306, 406) at one end and a plurality of holes (316) penetrating said base (309) from said first exterior surface toad first interior surface and opening to an interior side of said bathtub tile wall for collecting and diverting water, moisture, or other liquids from said interior side of said bathtub tile wall to said plurality of holes (316); and an extrusion (304) coupled to the dam (302, 402) at said base with a plurality of centrally located hollow cylindrical tubes (310) respectively coupled to said plurality of holes (316) in the dam (302, 304) and projecting to an exterior side of said bathtub tile wall for allowing said water, moisture, or other liquid to drain from said interior side to said exterior side of said bathtub tile wall (800).

9. The bathtub tile wall of claim 8 further comprising a second weep drain located at a second end of the bathtub tile wall (800) opposite said first end, said second weep drain comprising, a dam (302, 402) integrally coupled to the bathtub tile wall (800), the dam having a first exterior planar surface positioned in a plane parallel with a plane of said bathtub tile wall, a base (309) integrally engaged to said bathtub tile wall with a first-interior surface opposite said first exterior surface, the dam having a curved portion (306, 406) at one end and a plurality of holes (316) penetrating said base (309) from said first exterior surface to said first interior surface and opening to an interior side of said bathtub tile wall for collecting and diverting water, moisture, or other liquids from said interior side of said bathtub tile wall to said plurality of holes (316); and an extrusion (304) coupled to the dam (302, 402) at said base with a plurality of centrally located hollow cylindrical tubes (310) respectively coupled to said plurality of holes (316) in the dam (302, 304) and projecting to an exterior side of said bathtub tile wall for allowing water, moisture, or other liquids to drain from said interior side to said exterior side of said bathtub tile wall (800).

* * * * *